US011976814B2

(12) United States Patent
Liu et al.

(10) Patent No.: US 11,976,814 B2
(45) Date of Patent: May 7, 2024

(54) HOUSEHOLD STOVE BURNER WITH UPPER INTAKE AIR AND SUPER-HIGH POWER

(71) Applicant: GUANGDONG HORISUN KITCHEN APPLIANCES TECHNOLOGY CO., LTD., Zhongshan (CN)

(72) Inventors: Xinquan Liu, Zhongshan (CN); Liuming Tan, Zhongshan (CN)

(73) Assignee: GUANGDONG HORISUN KITCHEN APPLIANCES TECHNOLOGY CO., LTD., Zhongshan (CN)

( * ) Notice: Subject to any disclaimer, the term of this patent is extended or adjusted under 35 U.S.C. 154(b) by 0 days.

(21) Appl. No.: 17/793,038

(22) PCT Filed: Aug. 10, 2020

(86) PCT No.: PCT/CN2020/108178
§ 371 (c)(1),
(2) Date: Jul. 15, 2022

(87) PCT Pub. No.: WO2021/223341
PCT Pub. Date: Nov. 11, 2021

(65) Prior Publication Data

US 2024/0044485 A1 Feb. 8, 2024

(30) Foreign Application Priority Data

May 6, 2020 (CN) ..... 202010372288.0

(51) Int. Cl.
*F23D 14/06* (2006.01)

(52) U.S. Cl.
CPC ..... *F23D 14/06* (2013.01)

(58) Field of Classification Search
CPC .. F24C 3/126; F24C 3/085; F24C 3/08; F23D 2900/14063; F23D 2900/14062; F23D 14/06
(Continued)

(56) References Cited

U.S. PATENT DOCUMENTS 6,322,354 B1 11/2001 Carbone et al.
6,332,460 B1 * 12/2001 Paesani ..... F23D 14/06 126/39 R
(Continued)

FOREIGN PATENT DOCUMENTS

CN 108105768 A 1/2018
CN 108266728 A 7/2018
(Continued)

OTHER PUBLICATIONS

International Search Report and Written Opinion of CN2019/111546, dated Mar. 26, 2020.

*Primary Examiner* — Vivek K Shirsat
(74) *Attorney, Agent, or Firm* — Birchwood IP

(57) ABSTRACT

A household stove burner with upper intake air and super-high power includes cup body, distributor base, central distributor, outer ring distributor, ignition needle, induction needle, air intake base, central air intake tube, left air intake tube, right air intake tube, gap between central air intake tube, light tube portion of central tube. The gap between left air intake tube and light tube portion of left outer ring tube, gap is between right tube and light tube portion of right outer ring air intake tube, a lower end of air intake cavity of distributor base is docked with outer ring pre-mixing cavity, outer interface of outer ring distributor is inserted into outer ring fuel gas tank, inner ring wall plate of outer ring fuel gas tank inserted into outer ring distributor. Outer ring flame
(Continued)

stabilizing slot to prevent generation of outer ring firm flame to improve dissipation performance.

6 Claims, 8 Drawing Sheets

(58) Field of Classification Search
USPC ..... 126/39 N, 39 H, 39 R; 431/354
See application file for complete search history.

(56) References Cited

U.S. PATENT DOCUMENTS

| | | | | |
|---|---|---|---|---|
| 6,875,008 | B1 * | 4/2005 | Martin | F23C 6/047 431/9 |
| 2009/0142719 | A1 * | 6/2009 | Scheuring, III | F23D 14/04 431/354 |
| 2018/0119947 | A1 * | 5/2018 | Serenellini | F23D 14/08 |
| 2018/0259180 | A1 * | 9/2018 | Biagioli | F23D 14/065 |
| 2022/0316701 | A1 * | 10/2022 | Breccia | F23D 14/065 |
| 2023/0220992 | A1 * | 7/2023 | Koch | F23D 14/62 126/39 E |

FOREIGN PATENT DOCUMENTS

| | | | |
|---|---|---|---|
| CN | 110848680 | A | 2/2020 |
| CN | 210267207 | U | 4/2020 |

* cited by examiner

HOUSEHOLD STOVE BURNER WITH UPPER INTAKE AIR AND SUPER-HIGH POWER

CROSS-REFERENCE TO RELATED APPLICATIONS

This application is a continuation of co-pending International Patent Application No. PCT/CN2020/108178, filed on Aug. 10, 2020, which claims the priority and benefit of Chinese patent application number 202010372288.0, filed May 6, 2020 with China National Intellectual Property Administration, the entire contents of which are incorporated herein by reference.

TECHNICAL FIELD

The present disclosure relates to a household stove burner, in particular to a household stove burner with upper intake air and super-high power.

BACKGROUND

In the prior art, a household stove burner with upper intake air and super-high power includes a cup body, a distributor base, a central distributor, an outer ring distributor, an ignition needle and an induction needle. The cup body includes a base plate, a central distributor base penetrating through the base plate, a central fire air intake tube communicating with a lower end of the central distributor base, an outer ring pre-mixing cavity arranged on a lower surface at the rear of the base plate and passing through the base plate, a left outer ring air intake tube, a right outer ring air intake tube, a primary air intake cavity arranged at the front of the base plate, an ignition needle fixing hole and an induction needle fixing hole. The distributor base includes an outer ring fuel gas tank, and the distributor base is communicated with the outer ring pre-mixing cavity. Existing problems: poor heat dissipation performance, resulting in load increased along working time and great load reduction gradient.

SUMMARY

The purpose of the present disclosure is to provide a household stove burner with upper intake air and super-high power, which is has the characteristics of high power and small load reduction gradient.

The present disclosure is achieved as follows: a household stove burner with upper intake air and super-high power includes a cup body, a distributor base, a central distributor, an outer ring distributor, an ignition needle and an induction needle. The cup body includes a base plate, a central distributor base penetrating through the base plate, a central fire air intake tube communicating with a lower end of the central distributor base, an outer ring pre-mixing cavity arranged on a lower surface at the rear of the base plate and passing through the base plate, a left outer ring air intake tube, a right outer ring air intake tube, a primary air intake cavity arranged at the front of the base plate, an ignition needle fixing hole and an induction needle fixing hole. The distributor base includes an outer ring fuel gas tank, and the distributor base is communicated with the outer ring pre-mixing cavity. The household stove burner is characterized in that the outer ring pre-mixing cavity is a small semicircle, a slow flow and steady flow plate along an axial direction is arranged on a circular wall in the outer ring pre-mixing cavity, and the slow flow and steady flow plate is along a diameter line in forward and backward directions.

The central fire air intake tube includes a central inner screw cavity and a central light tube portion that are arranged in an air intake end, and a diameter of the central inner screw cavity is greater than that of the central light tube portion. The left outer ring air intake tube includes a left inner screw cavity and a left light tube portion that are arranged in the air intake end, and a diameter of the left inner screw portion is greater than that of the left light tube portion. The right outer ring air intake tube includes a right inner screw cavity and a right light tube portion that are arranged in the air intake end, and a diameter of the right inner screw portion is greater than that of the right light tube portion.

The primary air intake cavity includes a central air intake portion, a left air intake portion and a right air intake portion, the air intake end of the central fire air intake tube is provided with the pre-mixing cavity, which is communicated with the central air intake portion. The left air intake portion is communicated with a left space at the front of the air intake end of the left outer ring air intake tube, and the right air intake portion is communicated with a right space at the front of the air intake end of the right outer ring air intake tube.

A lower opened air intake cavity is formed in a base plate of the outer ring fuel gas tank of the distributor base, the air intake cavity is respectively provided a left diversion trench and a right diversion trench in anticlockwise and clockwise directions, and a top plate of the air intake cavity is provided with a radial plate.

The household stove burner further includes an air intake base, a central air intake tube, a left air intake tube and a right air intake tube.

The air intake base includes a central air intake interface, a central air outlet base in the central air intake interface, a transverse outer ring air intake tube, a left air outlet base, a right air outlet base and an outer ring air intake interface, and nozzles are respectively arranged on the central air outlet base, the left air outlet base and the right air outlet base.

An air intake end of the central air intake tube is arranged at the central outer screw base, an air intake end of the left air intake tube is arranged at the left outer screw base, and the right outer screw base is arranged on the right air intake tube.

The outer ring distributor includes an inner ring wall plate, a top inverted cone cover plate, an outer ring wall plate, an outer interface arranged at a lower end of the outer ring wall plate and a flame stabilizing plate surrounding the upper end of the outer ring wall plate. An outer ring combustion hole, an outer ring flame stabilizing slot and an air guide hole for communicating the outer ring flame stabilizing slot and the outer ring distributor inner cavity are formed in the outer ring wall plate. The outer ring flame stabilizing slot is located at the lower part of the outer ring combustion hole, an acute angle is between an axial line of the outer ring combustion hole and a radial outer level, and an acute angle is between the outer ring flame stabilizing slot and the radial outer level.

The central outer screw base of the central air intake tube is screwed with the central inner screw cavity of the central fire air intake tube, and a gap is between the central air intake tube and the light tube portion of the central fire air intake tube. The left outer screw base of the left air intake tube is screwed with the left inner screw cavity of the left outer ring air intake tube, and a gap is between the left air intake tube and the light tube portion of the left outer ring air intake tube. The right outer screw base of the right air intake tube is screwed with the right inner screw cavity of the right outer ring air intake tube, and a gap is between the right air intake tube and the light tube portion of the right outer ring air intake tube. The air intake base is fixedly connected to a front end of the base plate of the cup body, and nozzles on the central air outlet base, the left air outlet base and the right air outlet base are respectively opposite to the central air intake tube, the left air intake tube and the right air intake tube. A lower end of the air intake cavity of the distributor base is docked with the outer ring pre-mixing cavity, the outer interface of the outer ring distributor is inserted into the outer ring fuel gas tank, and the inner ring wall plate of the outer ring fuel gas tank is inserted into the outer ring distributor.

The household stove burner with upper intake air and super-high power is characterized in that: a screw hole is formed in the slow flow and steady flow plate, a connecting hole is formed in the top plate of the air intake cavity, the connecting hole penetrates through the radial plate, the slow flow and steady flow plate is docked with the radial plate, and a screw passes through the connecting hole and is screwed with the screw hole.

The household stove burner with upper intake air and super-high power is characterized in that: the two ends of the primary air intake cavity are provided with support column bases, in which screw holes are formed.

A connecting base is arranged on the base plate of the outer ring fuel gas tank of the distributor base, and the screw passes through the connecting hole on the connecting base and is screwed with the screw holes on the support column bases.

The household stove burner with upper intake air and super-high power is characterized in that: the volume of the air intake cavity is less than that of the outer ring pre-mixing cavity.

The household stove burner with upper intake air and super-high power is characterized in that: a central air intake hole is formed in the central light tube portion of the central fire air intake tube, a left air intake hole is formed in the left light tube portion of the left outer ring air intake tube, and a right air intake hole is formed in the right light tube portion of the right outer right air intake tube.

The household stove burner with upper intake air and super-high power is characterized in that: air outlet holes penetrating through the top plate are respectively formed in the two ends of the top plate of the lower opened air intake cavity of the distributor base.

The present disclosure is a household stove burner with upper intake air and super-high power. The outer ring flame stabilizing slot and the flame stabilizing plate are arranged on the outer ring distributor to prevent the generation of the outer ring firm flame. The central air intake tube and the light tube portion of the central fire air intake tube are arranged at intervals, the left air intake tube and the light tube portion of the left outer ring air intake tube are arranged at intervals, and the right air intake tube and the light tube portion of the right outer ring air intake tube are arranged at intervals, so that the heat dissipation performance is improved.

DETAILED DESCRIPTION

The present disclosure is further described in combination with drawings below.

Figure 1:
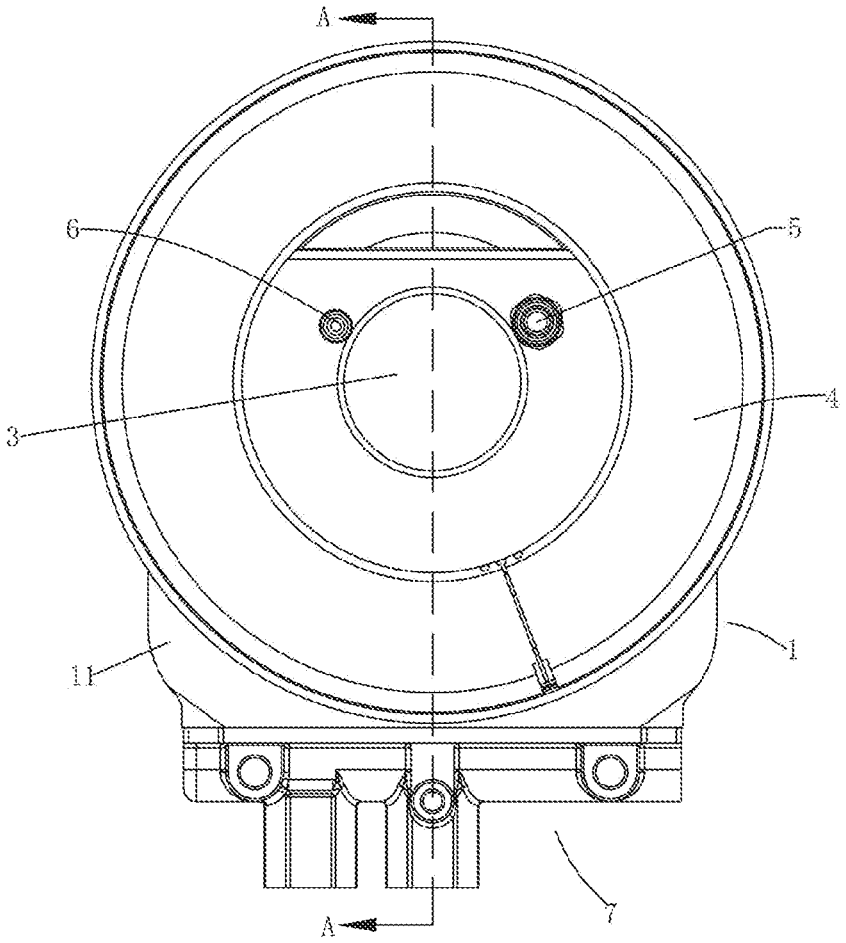
FIG. 1 is a front view of the present disclosure.
Figure 2:
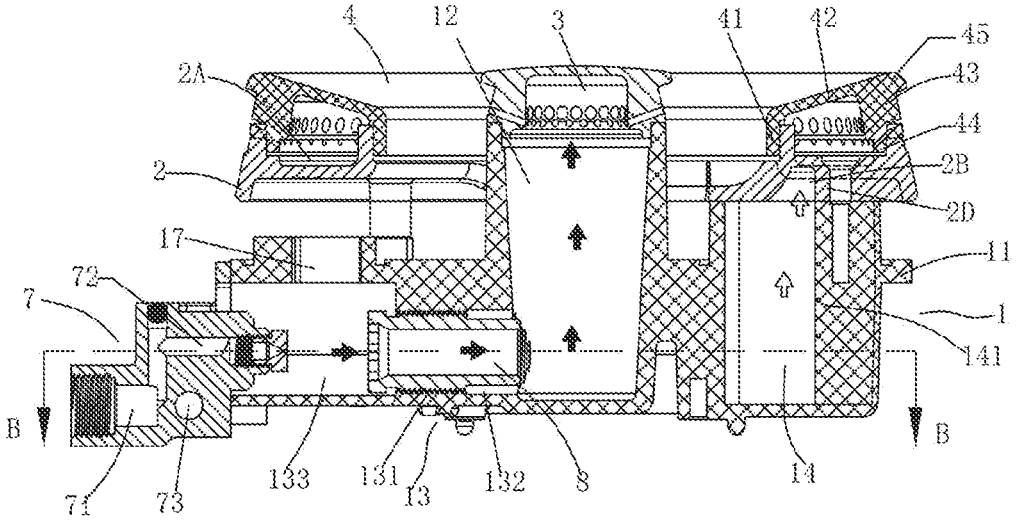
FIG. 2 is an A-A view of FIG. 1.
Figure 3:
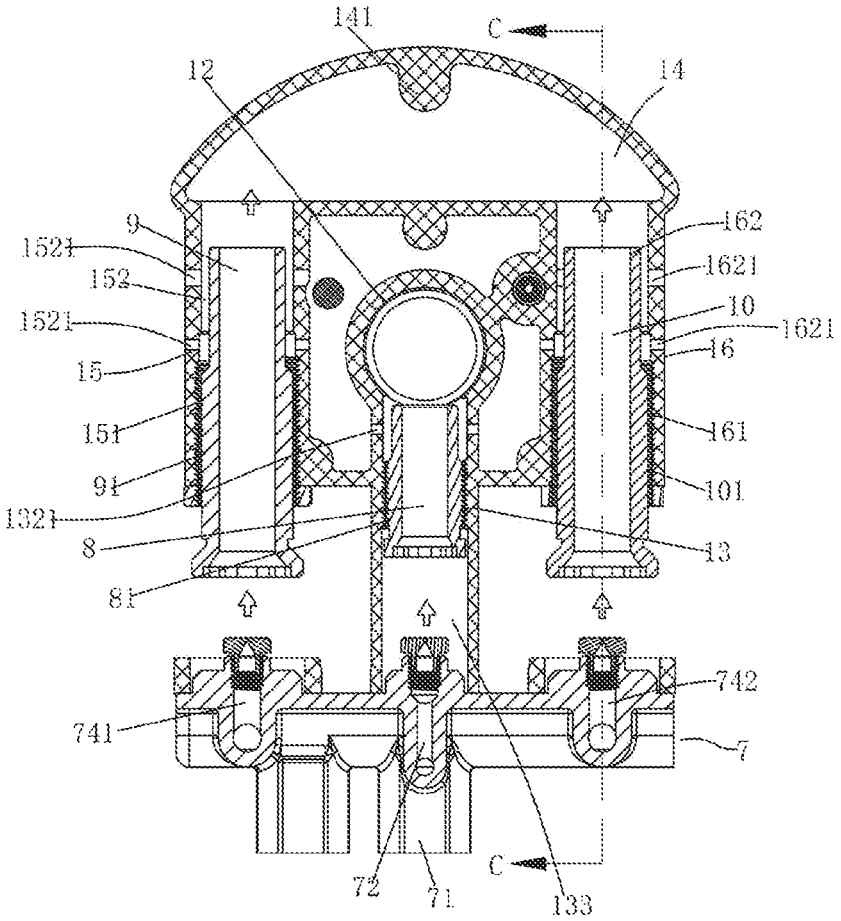
FIG. 3 is a B-B view of FIG. 2.
Figure 4:
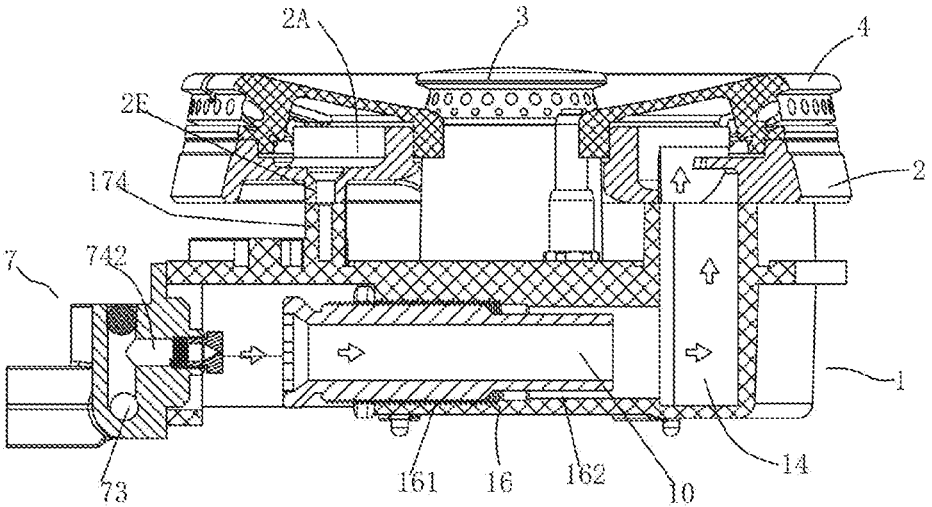
FIG. 4 is a C-C view of FIG. 3.
Figure 5:
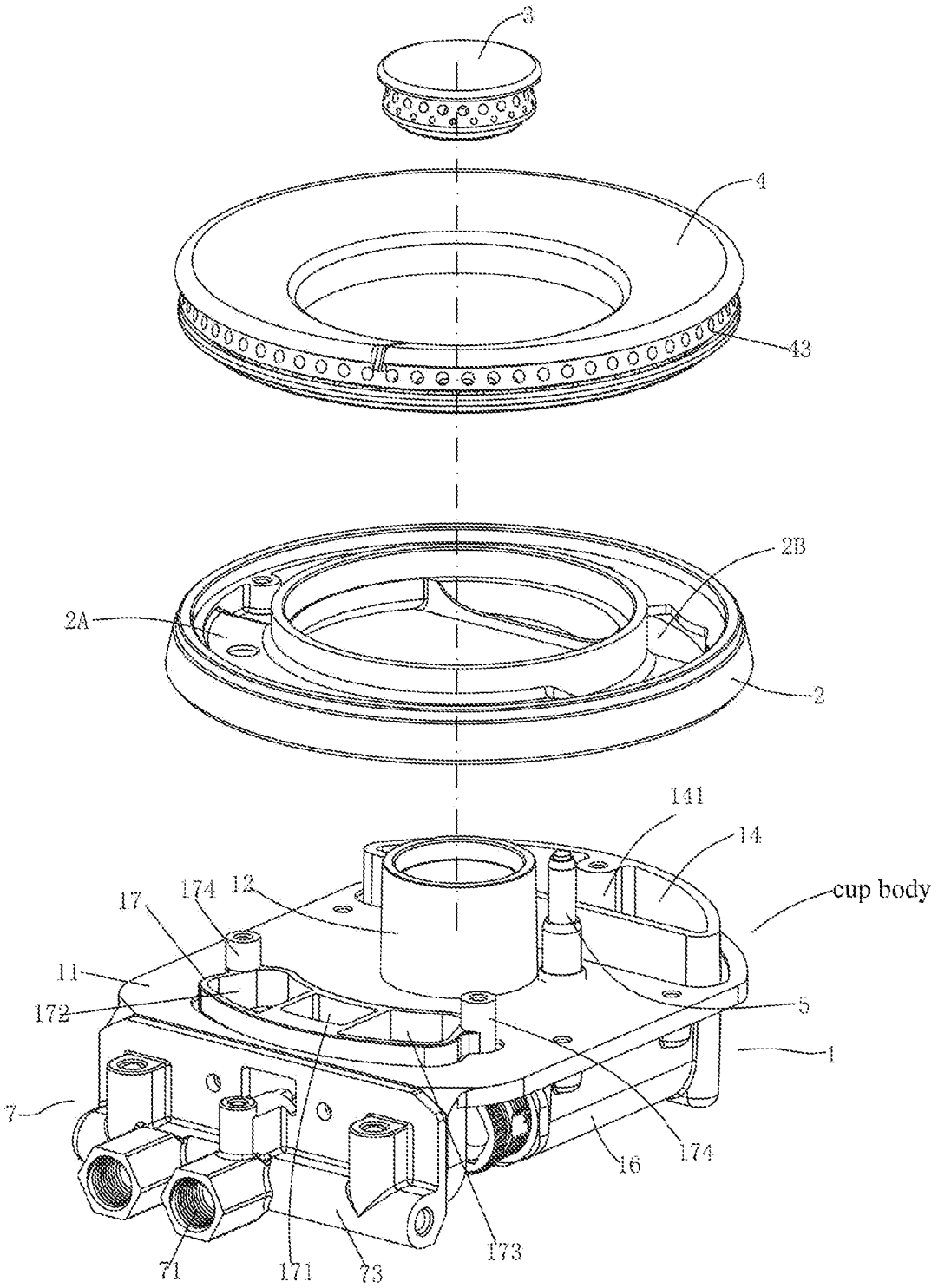
FIG. 5 is a first solid exploded view of the present disclosure.
Figure 6:
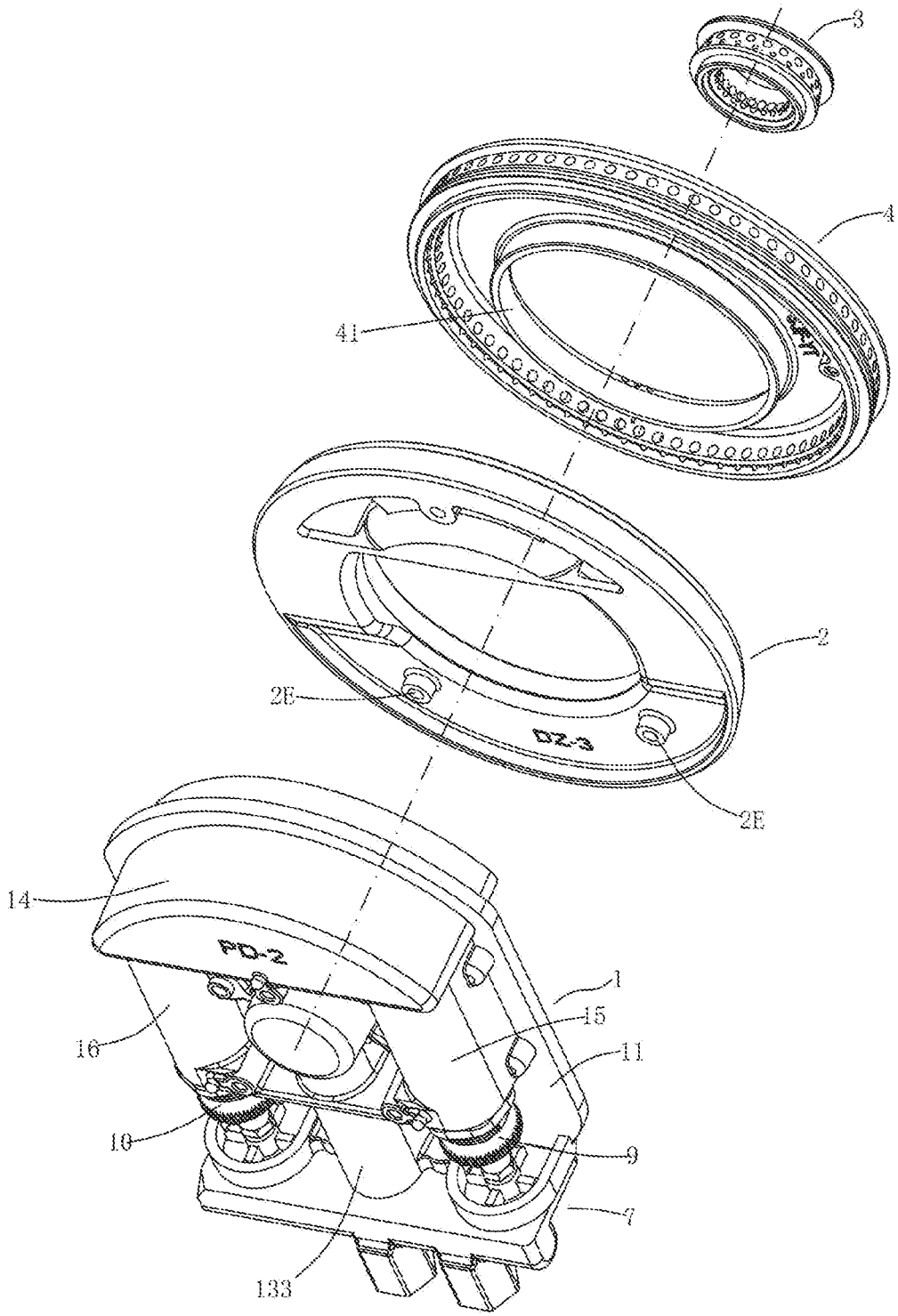
FIG. 6 is a second solid exploded view of the present disclosure.
Figure 7:
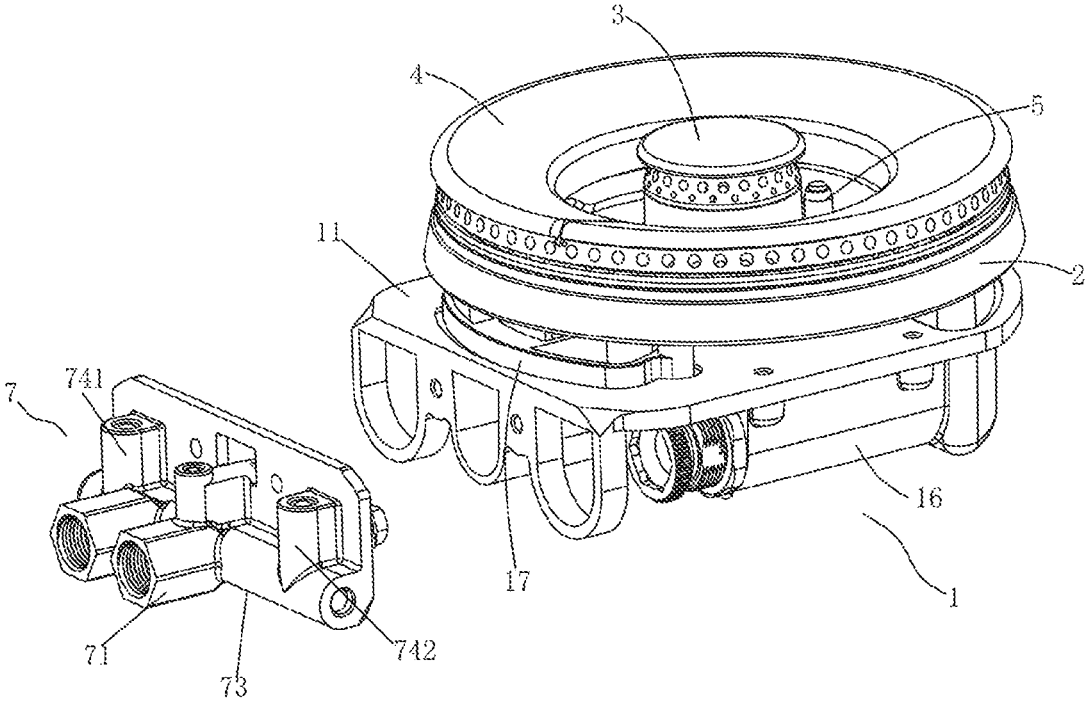
FIG. 7 is a third solid exploded view of the present disclosure.
Figure 8:
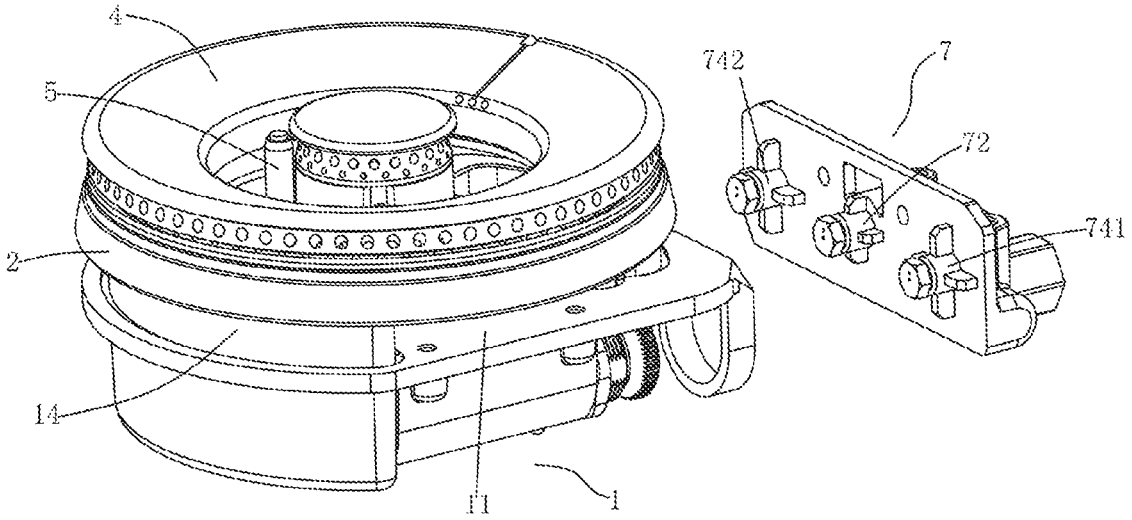
FIG. 8 is a fourth solid exploded view of the present disclosure.

As shown in FIG. 1 and FIG. 2, a household stove burner with upper intake air and super-high power includes a cup body 1, a distributor base 2, a central distributor 3, an outer ring distributor 4, an ignition needle 5 and an induction needle 6. The cup body 1 includes a base plate 11, a central distributor base 12 penetrating through the base plate, a central fire air intake tube 13 communicating with a lower end of the central distributor base, an outer ring pre-mixing cavity 14 arranged on a lower surface at the rear of the base plate and passing through the base plate, a left outer ring air intake tube 15, a right outer ring air intake tube 16, a primary air intake cavity 17 arranged at the front of the base plate, an ignition needle fixing hole and an induction needle fixing hole. The distributor base 2 includes an outer ring fuel gas tank 2A, and the outer ring fuel gas tank 2A of the distributor base 2 is communicated with the outer ring pre-mixing cavity 14.

The outer ring pre-mixing cavity 14 is a small semicircle, a slow flow and steady flow plate 141 along an axial direction is arranged on a circular wall in the outer ring pre-mixing cavity 14, and the slow flow and steady flow plate 141 is along a diameter line in the forward and back-ward directions. The small semicircular central angle is less than 180 degrees, and the chord length is less than the diameter of the round.

The central fire air intake tube 13 includes a central inner screw cavity 131 and a central light tube portion 132 that are arranged in an air intake end, and a diameter of the central inner screw cavity 131 is greater than that of the central light tube portion 132. The left outer ring air intake tube 15 includes a left inner screw cavity 151 and a left light tube portion 152 that are arranged in the air intake end, and a diameter of the left inner screw portion 151 is greater than that of the left light tube portion 152. The right outer ring air intake tube 16 includes a right inner screw cavity 161 and a right light tube portion 162 that are arranged in the air intake end, and a diameter of the right inner screw portion 161 is greater than that of the right light tube portion 162.

The primary air intake cavity 17 includes a central air intake portion 171, a left air intake portion 172 and a right air intake portion 173, the air intake end of the central fire air intake tube 13 is provided with the pre-mixing cavity 133, which is communicated with the central air intake portion 171. The left air intake portion 172 is communicated with a left space at the front of the air intake end of the left outer ring air intake tube 15, and the right air intake portion 173 is communicated with a right space at the front of the air intake end of the right outer ring air intake tube 16.

The lower opened air intake cavity 2B is formed in the base plate of the outer ring fuel gas tank 2A of the distributor base 2, the air intake cavity 2B is respectively provided the left diversion trench 2C1 and the right diversion trench 2C2 in anticlockwise and clockwise directions, and the top plate of the air intake cavity 2B is provided with the radial plate 2D. The air outlet holes 2B1 penetrating through the top plate are respectively formed in the two ends of the top plate of the lower opened air intake cavity 2B of the distributor base 2.

The household stove burner further includes an air intake base 7, a central air intake tube 8, a left air intake tube 9 and a right air intake tube 10.

The air intake base 7 includes a central air intake interface 71, a central air outlet base 72 in the central air intake interface, a transverse outer ring air intake tube 73, a left air outlet base 741, a right air outlet base 742 and an outer ring air intake interface 75. The outer ring air intake interface is communicated with the transverse outer ring air intake tube 73, the two ends of the transverse outer ring air intake tube 73 are communicated with the left air outlet base 741 and the right air outlet base 742, and nozzles are respectively arranged on the central air outlet base 72, the left air outlet base 741 and the right air outlet base 742.

The air intake end of the central air intake tube 8 is provided with a central outer screw base 81, the air intake end of the left air intake tube 9 is provided with a left outer screw base 91, and a right outer screw base 101 is arranged on the right air intake tube 10.

Figure 9:
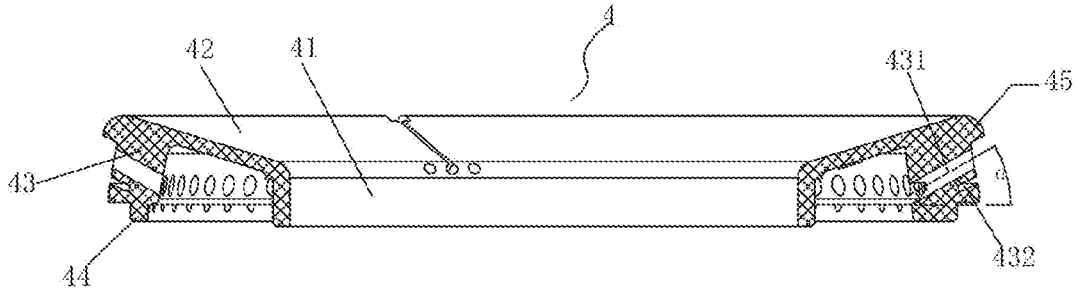
FIG. 9 is a first section view of an outer ring distributor of the present disclosure.
Figure 10:
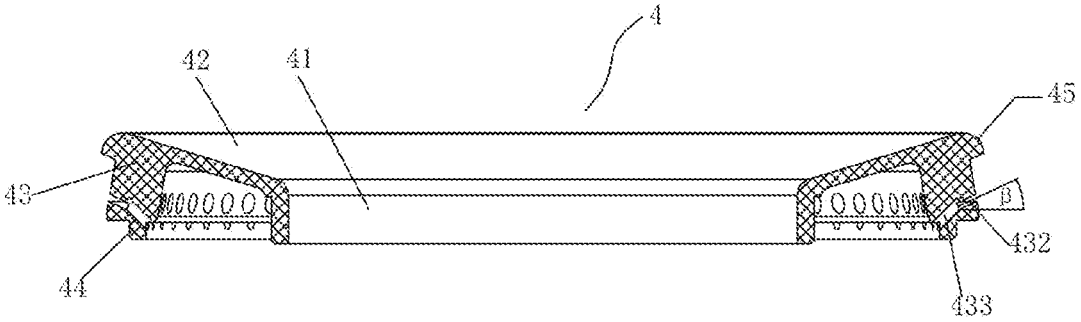
FIG. 10 is a second section view of an outer ring distributor of the present disclosure.
Figure 11:
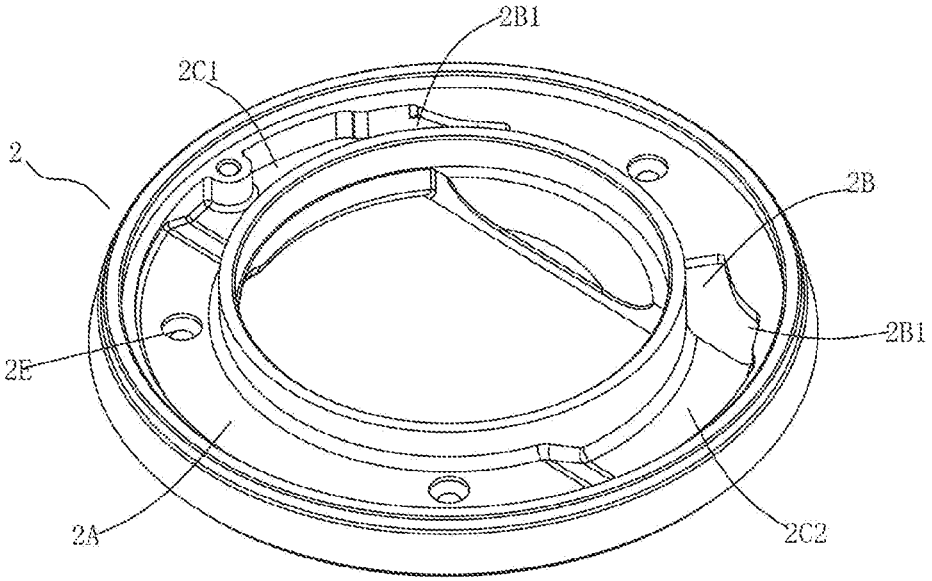
FIG. 11 is a first solid diagram of a distributor base of the present disclosure.
Figure 12:
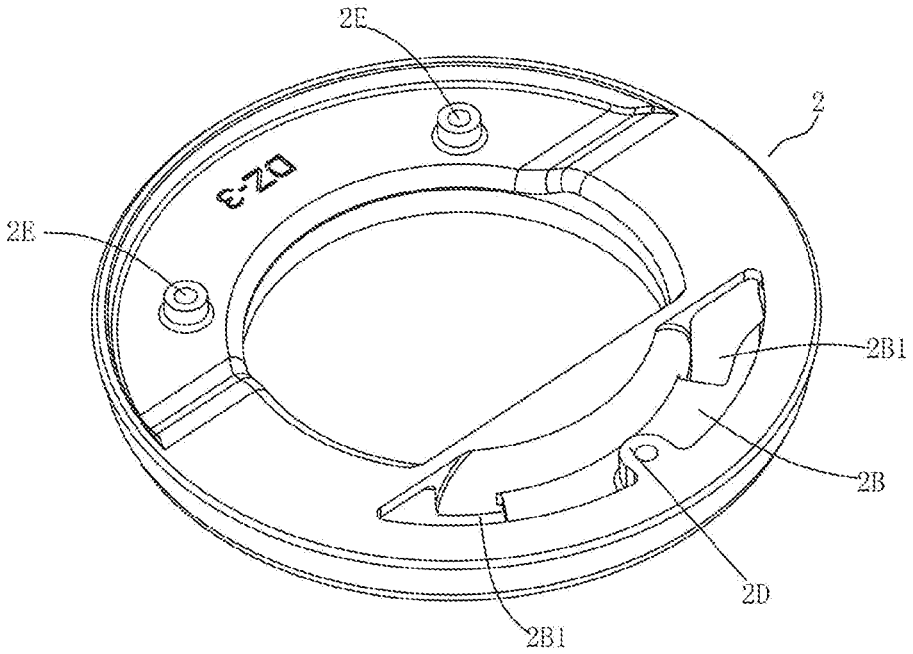
FIG. 12 is a second solid diagram of a distributor base of the present disclosure.
Figure 13:
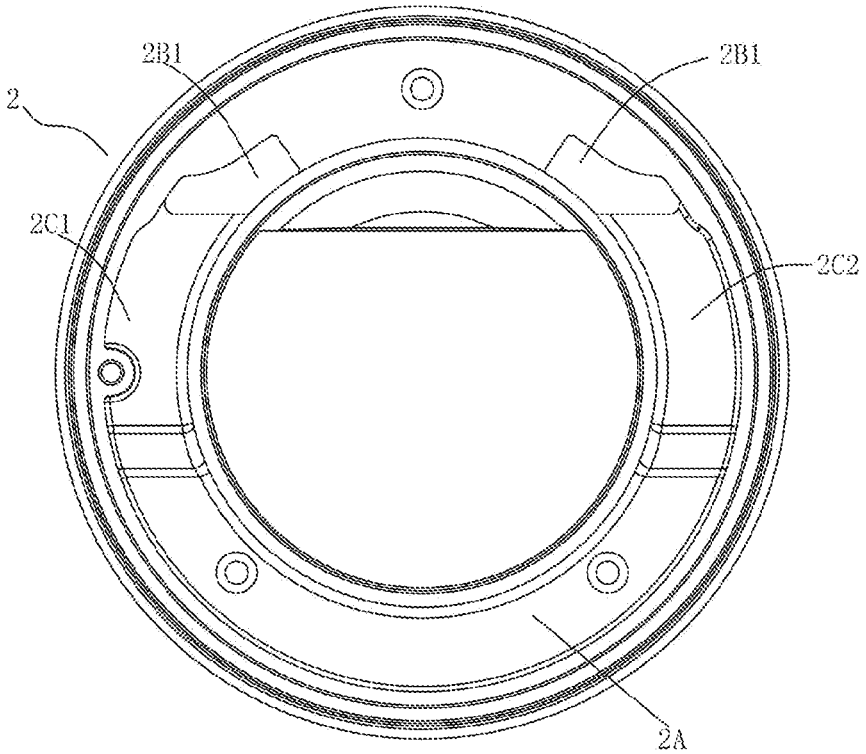
FIG. 13 is a front view of a distributor base of the present disclosure.

As shown in FIG. 9 and FIG. 10, the outer ring distributor 4 includes an inner ring wall plate 41, a top inverted cone cover plate 42, an outer ring wall plate 43, an outer interface 44 arranged at the lower end of the outer ring wall plate and a flame stabilizing plate 45 surrounding the upper end of the outer ring wall plate. An outer ring combustion hole 431, an outer ring flame stabilizing slot 432 and an air guide hole 433 for communicating the outer ring flame stabilizing slot 432 and the outer ring distributor inner cavity are formed in the outer ring wall plate 43. The outer ring flame stabilizing slot 432 is located at the lower part of the outer ring combustion hole 431, an acute angle $\alpha$ is between an axial line of the outer ring combustion hole 431 and a radial outer level, and an acute angle $\beta$ is between the outer ring flame stabilizing slot and the radial outer level. The flame stabilizing plate 45 is prepared by extending the top inverted cone cover plate 42 in the radial outer side, the outer ring flame stabilizing slot 432 burns the lower part of the flame of the outer ring combustion hole 431 to prevent the flame, and the flame stabilizing plate 45 also plays the role of preventing the flame.

The central outer screw base 81 of the central air intake tube 8 is screwed with the central inner screw cavity 131 of the central fire air intake tube 13, and the central gap is between the central air intake tube 8 and the light tube portion 132 of the central fire air intake tube 13. The setting of the central gap may reduce the temperature of the central air intake tube 8. The left outer screw base 91 of the left air intake tube 9 is screwed with the left inner screw cavity 151 of the left outer ring air intake tube 15, and the right gap is between the left air intake tube 9 and the light tube portion 152 of the left outer ring air intake tube 15. The setting of the left gap reduces the temperature of the left air intake tube 9. The right outer screw base 101 of the right air intake tube 10 is screwed with the right inner screw cavity 161 of the right outer ring air intake tube 16, and the left gap is between the right air intake tube 10 and the light tube portion 162 of the right outer ring air intake tube 16. The setting of the left gap reduces the temperature of the right air intake tube 10. The air intake base 7 is fixedly connected to the front end of the base plate 11 of the cup body 1, and the nozzles on the central air outlet base 72, the left air outlet base 741 and the right air outlet base 742 are respectively opposite to the central air intake tube, the left air intake tube and the right air intake tube. The lower end of the air intake cavity 2B of the distributor base 2 is docked with the outer ring pre-mixing cavity 14, the outer interface 44 of the outer ring distributor 4 is inserted into the outer ring fuel gas tank 3A, and the inner ring wall plate of the outer ring fuel gas tank 3A is inserted into the outer ring distributor 4.

As a further improvement of the present disclosure: a screw hole is formed in the slow flow and steady flow plate 141, a connecting hole is formed in the top plate of the air intake cavity 2B, the connecting hole penetrates through the radial plate 2D, the slow flow and steady flow plate 141 is docked with the radial plate 2D, and a screw passes through the connecting hole and is screwed with the screw hole.

The two ends of the primary air intake cavity 17 are provided with support column bases 174, in which screw holes are formed.

A connecting base 2E is arranged on the base plate of the outer ring fuel gas tank 2A of the distributor base 2, and the screw passes through the connecting hole on the connecting base 2E and is screwed with the screw holes on the support column bases 174.

The volume of the air intake cavity 2B is less than that of the outer ring pre-mixing cavity 14. When entering the air intake cavity 2B from the outer ring pre-mixing cavity 14, the mixed gas of the fuel gas and the air is compressed and quickly enters the left diversion trench 2C1 and the right diversion trench 2C2 from the air intake cavity 2B.

As a further improvement of the present disclosure: a central air intake hole 1321 along the radial direction is formed in the central light tube portion 132 of the central fire air intake tube 13, the central air intake hole 1321 is communicated with the central gap, and the central air intake hole 1321 plays the effects of entering primary air and heat dissipation. A left air intake hole 1521 is formed in the left light tube portion 152 of the left outer ring air intake tube 15, the left air intake hole 1521 is communicated with the left gap to play the effects of entering primary air and heat dissipation. A right air intake hole 1621 is formed in the right light tube portion 162 of the right outer ring air intake tube 16, and the right air intake hole 1621 is communicated with the right gap to play the effects of entering primary air and heat dissipation.

In the technical field of the household stove burner, the high power is 3.8-4.0 kw, and super-high power is above 5.0 kw.

When the technical solution of the present disclosure is above 5.0 kw, the load reduction gradient is small, so that the super-high power can be realized.

Figure 14:
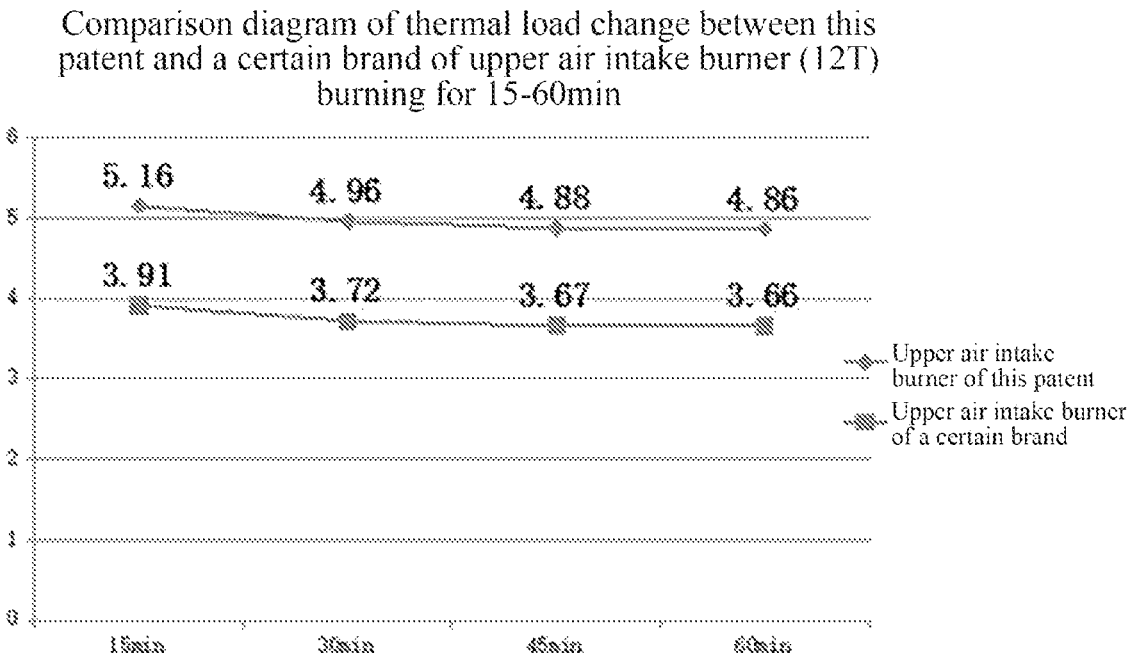
FIG. 14 is a thermal load variation diagram of the present disclosure and the prior art.

As shown in FIG. 14, the technical solution of the present disclosure may realize 5.2 kw, a test is carried out by the national standard testing method. According to the national standard testing method, the combustion of the present disclosure is 15 min, and the load is 5.16 kw.

For the current product sold in the market, the maximum power is 4 kw, the combustion is 15 min, and the load is 3.91 kw.

Figure 15:
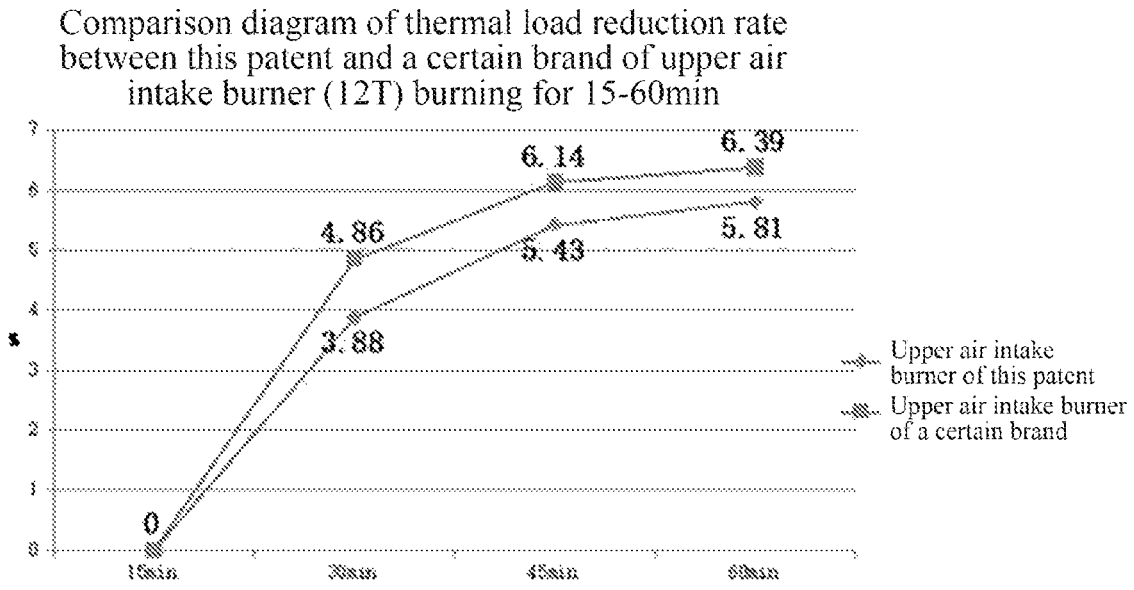
FIG. 15 is a thermal load reduction rate comparison diagram of the present disclosure and the prior art.

As shown in FIG. 15, based on the national standard and the actual measured load after burning for 15 min, the test is carried out every 15 min.

Compared with the load when burning for 15 min, when the present disclosure burns for 30 min, the load is reduced by 3.88%; compared with the load when burning for 15 min, when the present disclosure burns for 45 min, the load is reduced by 5.43%, and compared with the load when burning for 15 min, when the present disclosure burns for 60 min, the load is reduced by 5.81%.

Compared with the load when burning for 15 min, when the upper air intake burner sold in the market burns for 30 min, the load is reduced by 4.86%. Compared with the load when burning for 15 min, when the upper air intake burner burns for 45 min, the load is reduced by 6.14%, and compared with the load when burning for 15 min, when the upper air intake burner burns for 60 min, the load is reduced by 6.39%.

It can be known, from the above analysis and comparison, the thermal load reduction of the present disclosure is small, and the upper air intake burner sold in the market has great thermal load reduction.

The above is only the preferred implementation mode of the present disclosure. It is to be pointed out that those of ordinary skill in the art may further make a plurality of transformations and improvements without departing from the concept of the present disclosure and all of these fall within the scope of protection of the present disclosure.

What is claimed is:

1. A household stove burner with upper intake air and super-high power, comprising a cup body, a distributor base, a central distributor, an outer ring distributor, an ignition needle and an induction needle; the cup body comprises a base plate, a central distributor base penetrating through the base plate, a central fire air intake tube communicating with a lower end of the central distributor base, an outer ring pre-mixing cavity arranged on a lower surface at the rear of the base plate and passing through the base plate, a left outer ring air intake tube, a right outer ring air intake tube, a primary air intake cavity arranged at the front of the base plate, an ignition needle fixing hole and an induction needle fixing hole; the distributor base comprises an outer ring fuel gas tank, and the distributor base is communicated with the outer ring pre-mixing cavity, wherein the outer ring pre-mixing cavity is a semicircle, a steady flow plate along an axial direction is arranged on a circular wall in the outer ring pre-mixing cavity, and the steady flow plate is along a diameter line in forward and backward directions;

wherein the central fire air intake tube comprises a central inner screw cavity and a central light tube portion that are arranged in an air intake end, and a diameter of the central inner screw cavity is greater than that of the central light tube portion; the left outer ring air intake tube comprises a left inner screw cavity and a left light tube portion that are arranged in the air intake end, and a diameter of the left inner screw portion is greater than that of the left light tube portion; and the right outer ring air intake tube comprises a right inner screw cavity and a right light tube portion that are arranged in the air intake end, and a diameter of the right inner screw portion is greater than that of the right light tube portion;

wherein the primary air intake cavity comprises a central air intake portion, a left air intake portion and a right air intake portion, the air intake end of the central fire air intake tube is provided with the pre-mixing cavity, which is communicated with the central air intake portion; the left air intake portion is communicated with a left space at the front of the air intake end of the left outer ring air intake tube, and the right air intake portion is communicated with a right space at the front of the air intake end of the right outer ring air intake tube;

wherein a lower opened air intake cavity is formed in a base plate of the outer ring fuel gas tank of the distributor base, the air intake cavity is respectively provided a left diversion trench and a right diversion trench in anticlockwise and clockwise directions, and a top plate of the air intake cavity is provided with a radial plate;

wherein the household stove burner further comprises an air intake base, a central air intake tube, a left air intake tube and a right air intake tube, the air intake base comprises a central air intake interface, a central air outlet base in the central air intake interface, a transverse outer ring air intake tube, a left air outlet base, a right air outlet base and an outer ring air intake interface, and nozzles are respectively arranged on the central air outlet base, the left air outlet base and the right air outlet base; an air intake end of the central air intake tube is arranged at the central outer screw base, an air intake end of the left air intake tube is arranged at the left outer screw base, and a right outer screw base is arranged on the right air intake tube; the outer ring distributor comprises an inner ring wall plate, a top inverted cone cover plate, an outer ring wall plate, an outer interface arranged at a lower end of the outer ring wall plate and a flame stabilizing plate surrounding the upper end of the outer ring wall plate; an outer ring combustion hole, an outer ring flame stabilizing slot and an air guide hole for communicating the outer ring flame stabilizing slot and the outer ring distributor inner cavity are formed in the outer ring wall plate; the outer ring flame stabilizing slot is located at the lower part of the outer ring combustion hole, an acute angle is formed between an axial line of the outer ring combustion hole and a radial outer level, and an acute angle is formed between the outer ring flame stabilizing slot and the radial outer level;

wherein the central outer screw base of the central air intake tube is screwed with the central inner screw cavity of the central fire air intake tube, and a gap is between the central air intake tube and the light tube portion of the central fire air intake tube; the left outer screw base of the left air intake tube is screwed with the left inner screw cavity of the left outer ring air intake tube, and a gap is between the left air intake tube and the light tube portion of the left outer ring air intake tube; the right outer screw base of the right air intake tube is screwed with the right inner screw cavity of the right outer ring air intake tube, and a gap is between the right air intake tube and the light tube portion of the right outer ring air intake tube; the air intake base is fixedly connected to a front end of the base plate of the cup body, and nozzles on the central air outlet base, the left air outlet base and the right air outlet base are respectively opposite to the central air intake tube, the left air intake tube and the right air intake tube; a lower end of the air intake cavity of the distributor base is docked with the outer ring pre-mixing cavity, the outer interface of the outer ring distributor is inserted into the outer ring fuel gas tank, and the inner ring wall plate of the outer ring fuel gas tank is inserted into the outer ring distributor; a central air intake hole is formed in the central light tube portion of the central fire air intake tube, a left air intake hole is foi sued in the left light tube portion of the left outer ring air intake tube, and a right air intake hole is formed in the right light tube portion of the right outer ring air intake tube.

2. The household stove burner with upper intake air and super-high power according to claim 1, wherein a screw hole is formed in the steady flow plate, a connecting hole is formed in the top plate of the air intake cavity, the connecting hole penetrates through the radial plate, the steady flow plate is docked with the radial plate, and a screw passes through the connecting hole and is screwed with the screw hole.

3. The household stove burner with upper intake air and super-high power according to claim 1, wherein the two ends of the primary air intake cavity are provided with support column bases, in which screw holes are formed; wherein a connecting base is arranged on the base plate of the outer ring fuel gas tank of the distributor base, and a screw passes through the connecting hole on the connecting base and is screwed with the screw holes on the support column bases.

4. The household stove burner with upper intake air and super-high power according to claim 1, wherein the volume of the air intake cavity is less than that of the outer ring pre-mixing cavity.

5. The household stove burner with upper intake air and super-high power according to claim 1, wherein air outlet holes penetrating through the top plate are respectively formed in the two ends of the top plate of the lower opened air intake cavity of the distributor base.

6. The top-fed ultra-high-power household stove burner according to claim 1, wherein a central air inlet hole is formed in a central tube part of a central flame intake pipe; a left air inlet hole is formed in a left tube part of the left outer-ring intake pipe; and a right air inlet hole is formed in a right tube part of the right outer-ring intake pipe.

* * * * *